US009323256B1

(12) United States Patent
Zhang et al.

(10) Patent No.: US 9,323,256 B1
(45) Date of Patent: Apr. 26, 2016

(54) POWER CONTROLLER FOR AN INTEGRATED BOOST CONVERTER POWERED SYSTEM

(71) Applicant: Cirrus Logic, Inc., Austin, TX (US)

(72) Inventors: Lingli Zhang, Austin, TX (US); Johann Gaboriau, Austin, TX (US); Mehul Marolia, Austin, TX (US); Aiman Alhoussami, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 563 days.

(21) Appl. No.: 13/776,309

(22) Filed: Feb. 25, 2013

Related U.S. Application Data

(60) Provisional application No. 61/645,125, filed on May 10, 2012.

(51) Int. Cl.
*G05F 1/10* (2006.01)
*H01J 1/00* (2006.01)

(52) U.S. Cl.
CPC ..... *G05F 1/10* (2013.01)

(58) Field of Classification Search
CPC ..... H01J 1/00
USPC ..... 307/116
See application file for complete search history.

(56) References Cited

U.S. PATENT DOCUMENTS

2013/0181523 A1 * 7/2013 Zhang ..... H03F 3/217 307/35

* cited by examiner

*Primary Examiner* — Robert Deberadinis
(74) *Attorney, Agent, or Firm* — Jackson Walker L.L.P.

(57) ABSTRACT

In accordance with these and other embodiments of the present disclosure, a system and method include supplying, by a single boost converter, power to a first circuit that provides a circuit operation and power to a second circuit that provides another circuit operation. The system and method also include receiving, by a controller coupled to the single boost controller, an operating condition signal indicative of at least one of: (i) a power delivered by the single boost converter, and (ii) a temperature of the single integrated circuit. The system and method further include allocating, by the controller, power deliverable by the single boost converter between the first circuit and second circuit in response to the operating condition signal.

30 Claims, 4 Drawing Sheets

POWER CONTROLLER FOR AN INTEGRATED BOOST CONVERTER POWERED SYSTEM

RELATED APPLICATION

The present disclosure claims priority to U.S. Provisional Patent Application Ser. No. 61/645,125, filed May 10, 2012, which is incorporated by reference herein in its entirety.

FIELD OF THE DISCLOSURE

The present disclosure generally relates to an integrated circuit, and, more particularly, to using a single boost converter in a single integrated circuit that supplies power to two or more separate operational or functional circuits in the single integrated circuit.

BACKGROUND

Many mobile phones on the market today provide phone functionality and also have a built in camera with flash capability in order to take higher quality photos. These phones may require circuitry that enables audio functionality for the phone and the flash capability. Audio functionality for a mobile phone is not just limited to the phone functionality but can also include the audio functionality for playing music, games, and videos and running applications and programs.

The camera flashes on mobile phones often use light emitting diode (LED) flash drivers to enable flash capability. The majority of these flashes for mobile phones are enabled through a boosted LED flash driver (e.g., having a boost converter). The boost converter is used for powering the LED driver and works to provide a constant current source. Generally, the flash driver uses a boost converter that works as a constant current source wherein the flash driver is enabled using hardware pins and is configurable via an $I^2C$ interface. Such an exemplary LED flash driver is disclosed in Analogic Tech Product Datasheet MT 1271 for 1.5 A Step-Up Current Regulator for Flash LED dated April 2009.

Also, mobile phones on the market today often use a boosted audio amplifier for higher and louder audio quality. A boosted audio amplifier comprises a boost converter powering an audio amplifier. By boosting the audio amplifier, the sound output of the amplifier may be increased and made louder. In addition, by boosting the voltage to a higher voltage level, the sound output may not be clipped by the battery voltage threshold because the audio amplifier will not be limited to the voltage supplied by the battery.

Different types of audio amplifiers exist. Such types of amplifiers include but are not limited to Class D, H, A, B, and A-B amplifiers. A boosted class-D amplifier may deliver a higher output power independent of the battery voltage because the boost can guarantee constant delivery of power to the audio amplifier. When a boost converter is used for powering a class-D amplifier, the boost converter works to provide a constant voltage source to the audio amplifier. In another case, a class-H scheme is implemented to maximize the boost converter efficiency by varying the boost output voltage at a certain signal level. At each respective signal level, the boost converter works to provide a corresponding constant voltage source. One disadvantage of the powering scheme for a boosted Class-D amplifier is that the overall system cost and size increase due to the requirements of additional components related to operating the boost converter with the audio amplifier.

Because both the LED flash driver and the audio amplifier require a similar or same type of boost converter, there is a desire and need for both the LED flash driver and audio amplifier to be supplied by a single boost converter.

FIG. 1 depicts an exemplary block diagram of an LED flash driver and audio amplifier power supply in accordance with the prior art in which a single boost converter is used to simultaneously drive both the LED flash driver and audio amplifier power supply. Such an exemplary circuit implementation is disclosed in Texas Instruments Datasheet for TPS61300, TPS61301, TPS61305 entitled "1.5 A/4.1 A Multiple LED Camera Flash Driver with 12CTM Compatible Interface" dated June 2009 and revised September 2010. Referring to FIG. 1, a constant DC voltage supply 102 may be coupled to a capacitor 104 and an inductor 106. Moreover, the inductor 106 may be coupled to an integrated circuit ("IC") 108 that comprises a single boosted LED driver and controller. The boosted LED flash driver IC 108 may drive the LED flash light using another capacitor 110 and diodes 112, 114. The LED flash driver IC 108 may also drive an audio amplifier 124. The audio amplifier 124 may comprise a Class-D amplifier 120, two audio inputs 116, 118 and a speaker system 122 that outputs an audio signal. Control of LED flash driver IC 108 and audio amplifier 124 may be provided at the board level. Such control at the board level may be provided through system software that uses a General Purpose Input/Output (GPIO) port of the LED flash driver IC 108, or an $I^2C$ interface. Such control may involve the exclusive operation of either the LED flash driver IC 108 or audio amplifier 124, or operating the LED flash driver IC 108 and the audio amplifier 124 simultaneously. When operating simultaneously, the control may include reducing the gain of the audio amplifier 124. Because the audio amplifier 124 is external to the controller in LED flash driver IC 108, the audio signal level may not be monitored before the LED flash is turned on. Thus, the gain amount of the audio signal that needs to be attenuated is hard to determine, and in most cases, due to the high crest factor of music contents, a need to reduce audio gain may not even exist. Thus, the controller for the LED flash driver 108 may be limited to being used to control the audio amplifier 124.

Therefore, it may be desirable to provide a way to control both the LED flash driver and the audio amplifier by using a controller that is on a single integrated circuit. Such a solution is disclosed in U.S. Utility patent application Ser. No. 13/548,963 filed Jul. 13, 2012, and entitled "Chip Level Integration of a Boosted Class-D Amplifier and Integrated LED Flash Driver," which is incorporated by reference herein in its entirety.

When a boost converter system is used to deliver power to multiple loads, a number of problems may occur due to limited battery capacity, inductor saturation, over-heating, and power delivery limitations of the boost converter. Traditional solutions typically focus on electrical overload protection by limiting the current of the boost converter or over-temperature protection by disabling the boost converter. With such solutions, typically no on-chip management of the boost converter load is attempted in order to maintain regulated operation within its maximum deliverable power and within its desired temperature range. Accordingly, it may be desirable to allow a user a choice to optimize audio quality, LED flash current, or both, and allocate power between boosted components based on such user preferences.

SUMMARY

In accordance with the present disclosure, disadvantages and problems associated with power budgeting in an integrated boost converter power system may be reduced or eliminated.

In accordance with embodiments of the present disclosure, a single integrated circuit may include a single boost converter, a first circuit that provides a circuit operation and is coupled to the single boost converter, a second circuit that provides another circuit operation and is coupled to the single boost converter, and a controller coupled to the single boost controller. The single boost converter may supply power to the first circuit and the second circuit. The controller may be configured to receive an operating condition signal indicative of at least one of: (i) a power delivered by the single boost converter; and (ii) a temperature of the single integrated circuit. In response to the operating condition signal, the controller may allocate power deliverable by the single boost converter between the first circuit and the second circuit.

In accordance with these and other embodiments of the present disclosure, a method may include supplying, by a single boost converter, power to a first circuit that provides a circuit operation and power to a second circuit that provides another circuit operation. The method may also include receiving, by a controller coupled to the single boost controller, an operating condition signal indicative of at least one of: (i) a power delivered by the single boost converter; and (ii) a temperature of the single integrated circuit. The method may further include allocating, by the controller, power deliverable by the single boost converter between the first circuit and second circuit in response to the operating condition signal.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are exemplary and explanatory and are not restrictive of the claims set forth in this disclosure.

DETAILED DESCRIPTION

Figure 1:
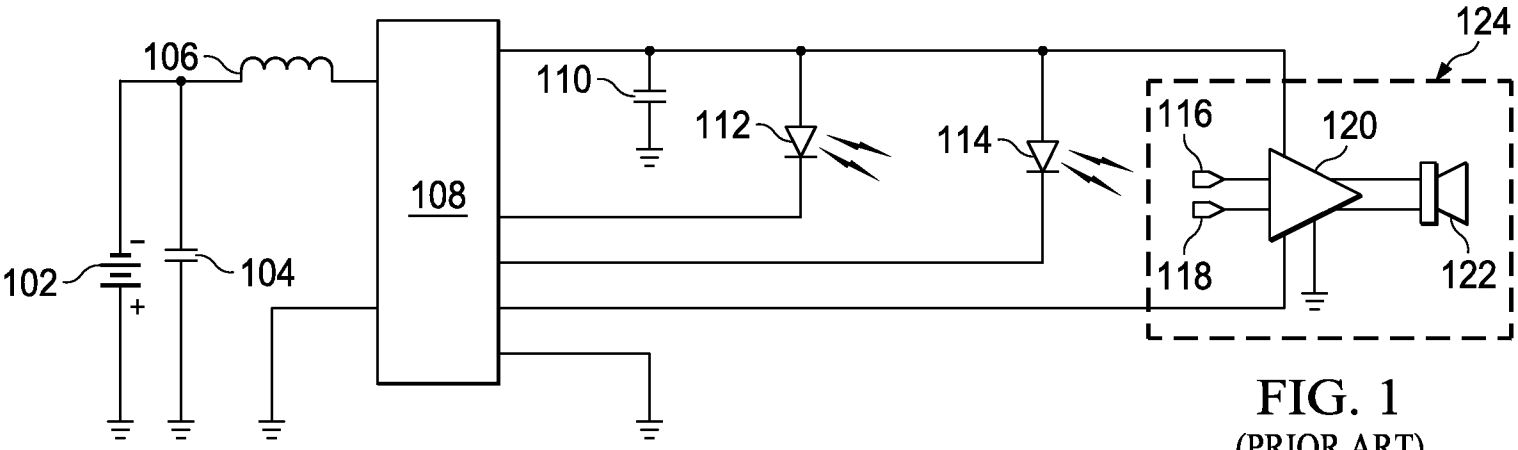
FIG. 1 (PRIOR ART)
FIG. 1 illustrates a block diagram of an example LED flash driver and audio amplifier power supply in which a single boost converter is used to simultaneously drive both the LED flash driver and audio amplifier power supply, as is known in the art.
Figure 2:
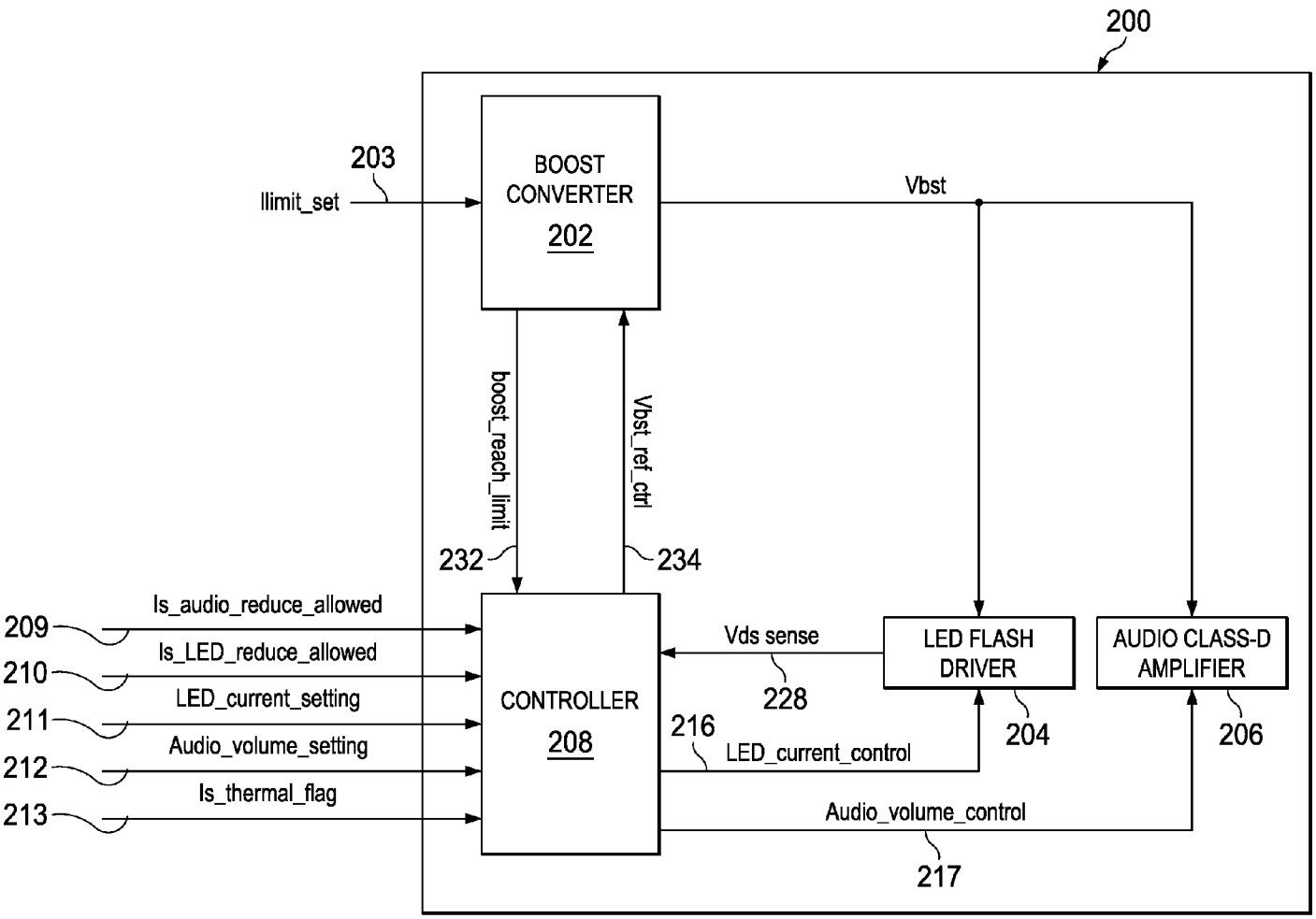
FIG. 2 illustrates a block diagram of an exemplary single integrated circuit that uses a single boost converter in the single integrated circuit that supplies power to two or more separate operational or functional circuits, such as an LED flash driver and an audio amplifier, in the single integrated circuit, in accordance with embodiments of the present disclosure.

FIG. 2 illustrates a block diagram of an exemplary single integrated circuit ("IC") 200 that uses a single boost converter 202 in the IC 200 that supplies power to two or more separate operational or functional circuits, such as an LED flash driver 204 and an audio amplifier 206, in the IC 200, in accordance with embodiments of the present disclosure. LED flash driver 204 may provide LED flash driver circuit operations, and audio amplifier 206 may provide audio amplification circuit operations. Single IC 200 comprises a controller 208 coupled to single boost converter 202, LED flash driver 204, and audio amplifier 206. The single boost converter 202 may be configured to drive both the LED flash driver 204 and audio amplifier 206, wherein the LED flash driver 204 requires a constant current in order to drive the LED flash and the audio amplifier 206 requires a constant voltage to operate. As shown in FIG. 2, boost converter 202 may receive an external boost converter limit setting Ilimit_set signal 203 (e.g., a setting regarding a maximum operating current, maximum operating power, or other maximum operating parameter of boost converter 202). In addition or alternatively, boost converter 202 may receive a reference control signal Vbst_ref_ctrl 234 (e.g., a control signal indicative of an output voltage level $V_{bst}$ to be generated by boost converter 202 in order to drive LED driver 204 and/or audio amplifier 206). Based on limit_set signal 203 and/or Vbst_ref ctrl signal 234, boost converter 202 may generate output voltage $V_{bst}$. In addition or alternatively, boost converter 202 may output an operating condition signal reach_boost_limit 232 indicative of the power delivered by boost converter 202 to LED flash driver 204, audio amplifier 206, and/or other components of IC 200. In some embodiments, boost_reach_limit signal 232 may be indicative of an aggregate power consumption of the LED flash driver 204 and the audio amplifier 206. In these and other embodiments, reach_boost_limit signal 232 may be indicative of whether the power delivered by boost converter 202 exceeds a threshold power level (e.g., a power limit of boost converter 202 as given by Ilimit_set signal 203).

Controller 208 may be coupled to all three blocks of IC 200 that enables both LED flash and audio capability. As shown in FIG. 2, controller 208 may receive one or more external operational mode signal, such as is_audio_reduce_allowed signal 209 (e.g., an audio volume reduction setting regarding whether the controller is permitted to reduce an audio volume for audio amplifier 206 below an audio volume setting), is_led_reduce_allowed signal 210 (e.g., a current reduction setting regarding whether the controller is permitted to reduce a current for LED flash driver 204 below a current setting), LED_current_setting 211 (e.g., a current setting for LED flash driver 204), and audio_volume_setting 212 (e.g., a volume setting for audio amplifier 206). In addition or alternatively, controller 208 may receive an operating condition signal is_thermal_flag 213 indicative of a temperature of the single integrated circuit. In some embodiments, operating condition signal is_thermal_flag 213 may be indicative of whether the temperature of the single integrated circuit exceeds a threshold temperature level. In addition or alternatively, controller 208 may also receive operating condition signal reach_boost_limit 232.

Figure 3:
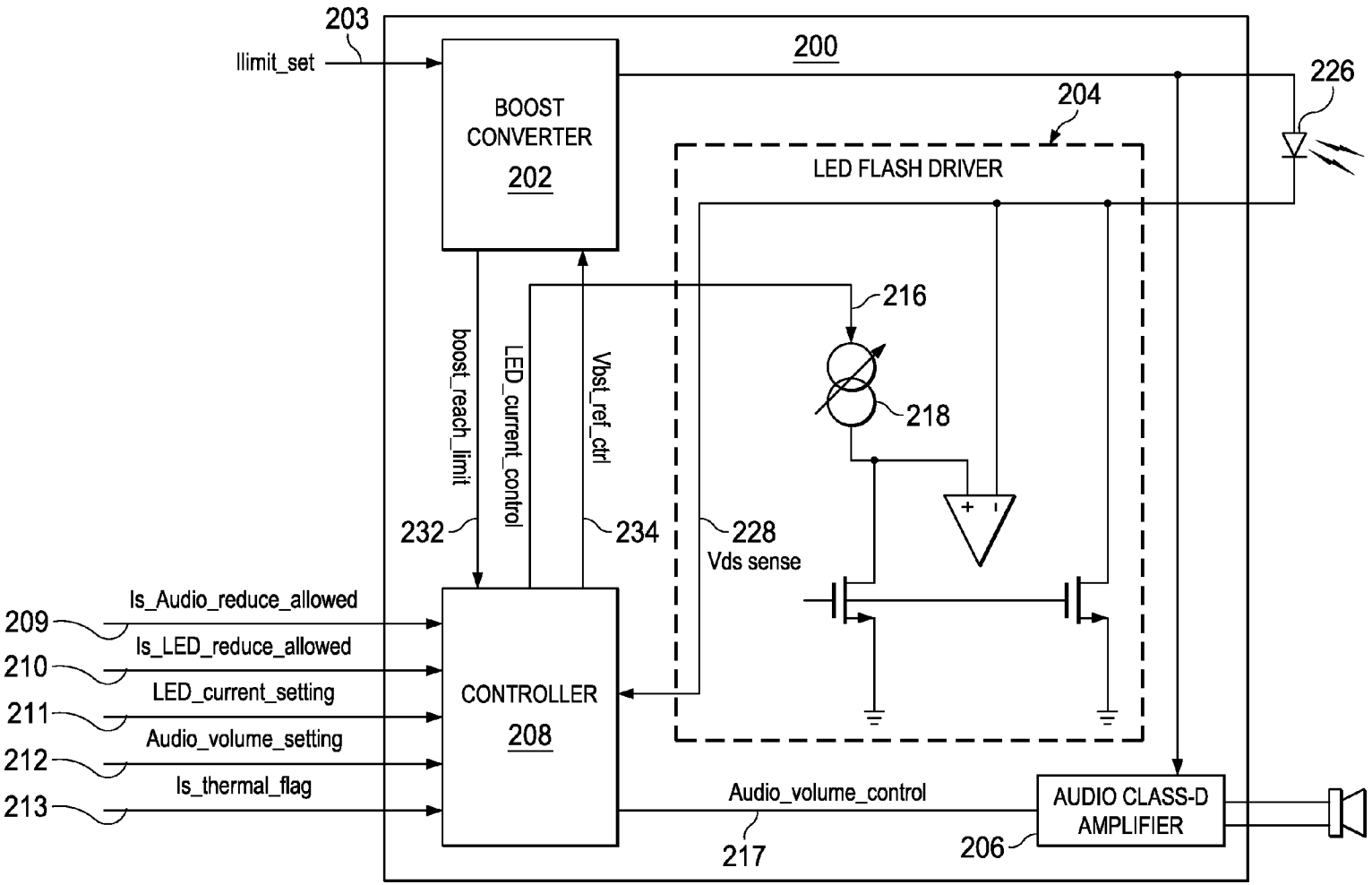
FIG. 3 illustrates a more detailed block diagram of an LED flash driver to which the single boost converter in the single integrated circuit supplies power, in the single integrated circuit, in accordance with embodiments of the present disclosure.

As depicted in FIG. 2, LED flash driver 204 may be supplied with boosted power from boost converter 202 that is set by controller 208 in order to maintain constant current for LED flash driver 204 to operate its flash capability. FIG. 3 illustrates a more detailed block diagram of LED flash driver 204, in accordance with embodiments of the present disclosure. LED flash driver 204 may receive a control input signal LED_current_control 216 from controller 208 and may forward control input signal 216 from controller 208 to a current source 218. Current source 218 may be configured to adjust and set the current accordingly using the ratio systematic implementation of two field effect transistors ("FETs"). Once the current has been adjusted to drive the LED flash diode 226, a real time voltage at the output of the LED flash diode 226 may be fed back to controller 208 through feedback voltage signal Vds_sense 228. This real time feedback voltage signal 228 may factor in and account for different forward voltage drops of the flash being used (e.g., the forward voltage drops of LED flash diode 226). Thus, controller 208 may, based on one or more operational mode signals (e.g., is_led_reduce_allowed signal 210, LED_current_setting signal 211), one or more operating condition signals (e.g., reach_boost_limit signal 232, is_thermal_flag signal 213), and/or feedback voltage signal Vds_sense 228, generate LED_current_control signal 216 in order to control the current of LED flash driver 204, thus controlling the power consumption of LED flash driver 204, as described in greater detail elsewhere in this disclosure.

As shown in FIG. 2, audio Class D amplifier 206 may be supplied with boosted power from boost converter 202 that is set by controller 208 in order to maintain constant voltage for the audio amplifier 206 to maintain operations. Controller 208 may, based on one or more operational mode signals (e.g., is_audio_reduce_allowed signal 209, audio_volume_setting signal 212), one or more operating condition signals (e.g., reach_boost_limit signal 232, is_thermal_flag signal 213), and/or feedback voltage signal Vds_sense 228, generate audio_volume_control signal 217 in order to control the audio volume for audio amplifier 206, thus controlling the power consumption of audio amplifier 206, as described in greater detail elsewhere in this disclosure.

In operation, controller 208 may, in response to one or more operating condition signals (e.g., reach_boost_limit signal 232, is_thermal_flag signal 213) and one or more operation mode signals (e.g., is_audio_reduce_allowed signal 209, is_led_reduce_allowed signal 210, LED_current_setting signal 211, audio_volume_setting signal 212), allocate power deliverable by boost converter 202 between LED flash driver 204 and audio amplifier 206. For example, if boost_reach_limit signal 232 indicates that power delivered by boost converter 202 exceeds a threshold power level (e.g., defined by Ilimit_set signal 203), controller 208 may generate one or more appropriate signals for LED_current_control signal 216 and/or audio_volume_control signal 217 in order to reduce the individual power consumption of at least one of the flash LED driver 204 and the audio amplifier 206. As another example, if is_thermal_flag signal 213 indicates that an over-temperature condition exists associated with IC 200, controller 208 may generate one or more appropriate signals for LED_current_control signal 216 and/or audio_volume_control signal 217 in order to reduce the individual power consumption of at least one of flash LED driver 204 and audio amplifier 206. In both examples (e.g., power exceeding threshold power level, over-temperature condition), controller 208 may determine whether to reduce the individual power consumption of flash LED driver 204, audio amplifier 206, or both, based on operation mode signals (e.g., is_audio_reduce_allowed signal 209, is_led_reduce_allowed signal 210) indicative of whether either the current for LED flash driver 204 or the volume of audio amplifier 206 may be reduced below their respective current and volume settings.

In conditions in which power delivered by boost converter 202 does not exceed its limit and no over-temperature condition exists, controller 208 may allocate power deliverable by boost converter 202 in accordance with operation mode signals (e.g., LED_current_setting signal 211, audio_volume_setting signal 212) indicative of desired operating parameters of LED flash driver 204 and/or audio amplifier 206.

Figure 4:
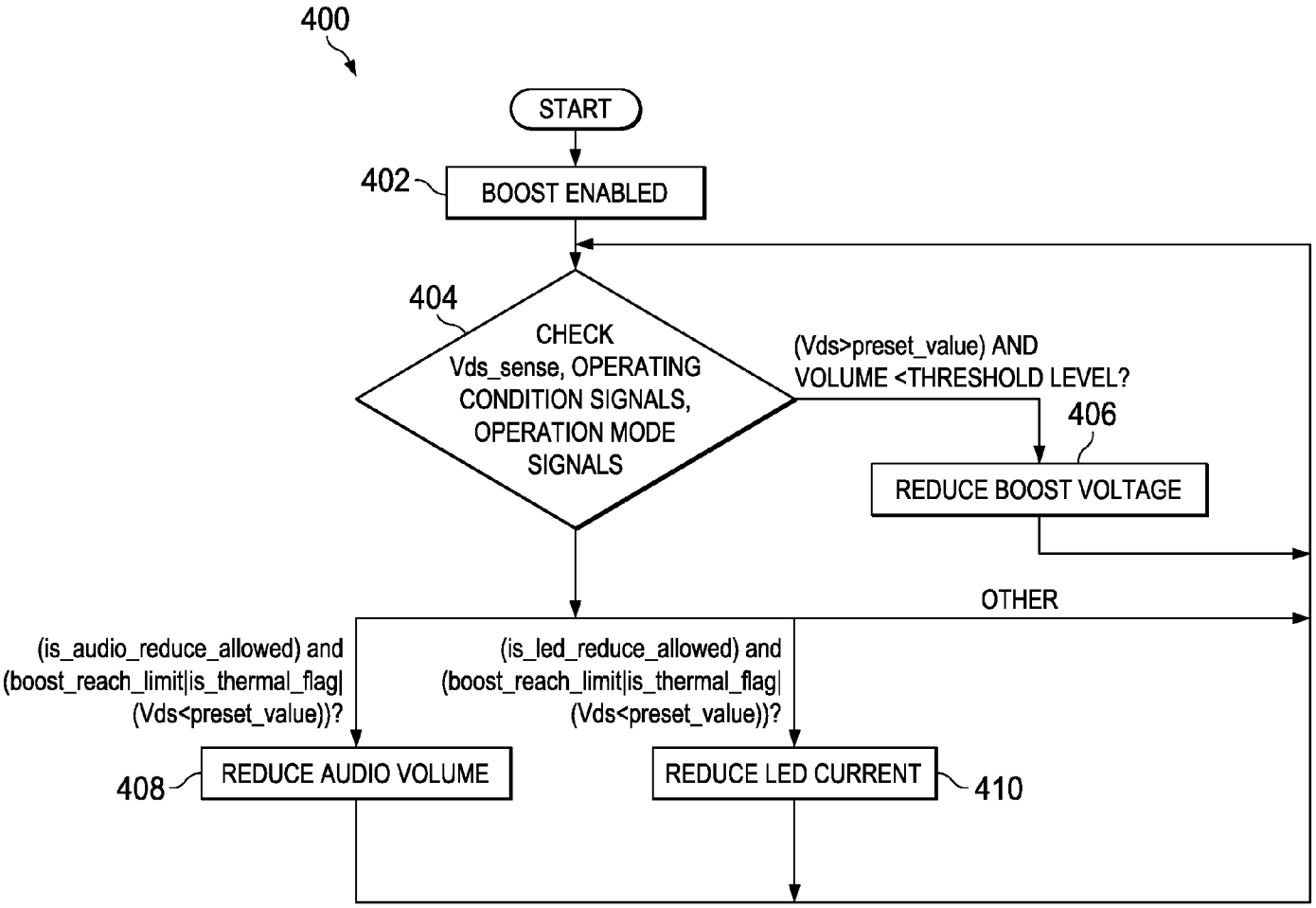
FIG. 4 illustrates a flow chart of an exemplary method for controlling power delivery from a single boost converter in a single integrated circuit to an LED flash driver and an audio amplifier in the single integrated circuit, in accordance with embodiments of the present disclosure.

FIG. 4 illustrates a flow chart of an exemplary method 400 for controlling power delivery from single boost converter 202 in single IC 200 to LED flash driver 204 and audio amplifier 206 in single IC 200, in accordance with embodiments of the present disclosure. According to certain embodiments, method 400 may begin at step 402. As noted above, teachings of the present disclosure may be implemented in a variety of configurations of IC 200. As such, the preferred initialization point for method 400 and the order of the steps 402-410 comprising method 400 may depend on the implementation chosen.

At step 402, boost converter 202 may be enabled to generate a boosted voltage for flash LED driver 204 and/or audio amplifier 206. During such process, the current of flash LED driver 204 and volume of audio amplifier 206 may be set to desired values in accordance with operation mode signals (e.g., LED_current_setting signal 211, audio_volume_setting signal 212).

At step 404, controller 208 may determine values of vds_sense signal 228 and operating condition signals (e.g., reach_boost_limit signal 232, is_thermal_flag signal 213) in order to determine whether to reduce boost voltage $V_{bst}$, reduce current of flash LED driver 204, and/or reduce volume of audio amplifier 206. If it is determined that vds_sense signal 216 is below a threshold level (e.g., 0.5 volts) and the volume of audio amplifier 206 is below a threshold level, boost may be reduced and method 400 may proceed to step 406. If it is determined that delivery of power by boost converter 202 has reached its limit (e.g., as indicated by reach_boost_limit signal 232), that an over-temperature condition has occurred (e.g., as indicated by is_thermal_flag signal 213), or that the vds_sense signal 216 is below a threshold level (e.g., 0.3 volts, potentially indicating that flash LED driver 204 is not sinking or sourcing adequate current), method 400 may proceed to step 408 and/or step 410. If one or more of the foregoing conditions exists, and audio amplifier 206 volume reduction is allowed (e.g., as indicated by is_audio_reduce_allowed signal 209), method 400 may proceed to step 408. If one or more of such conditions exist, and reduction of current of flash LED driver 204 is allowed, method 400 may proceed to step 410 in which the current of flash LED driver 204 is reduced. If none of the applicable conditions exist, method 400 may remain at step 404 until such conditions occur.

At step 406, in response to a determination that vds_sense signal 216 is below a threshold level (e.g., 0.5 volts) and the volume of audio amplifier 206 is below a threshold level, controller 208 may reduce boost voltage $V_{bst}$ by communicating an appropriate Vbst_ref ctrl signal 234 to boost converter 202. After completion of step 406, method 400 may proceed again to step 404.

At step 408, in response to a determination that delivery of power by boost converter 202 has reached its limit, that an over-temperature condition has occurred, or that the vds_sense signal 216 is below a threshold level, and that audio amplifier 206 volume reduction is allowed, controller 208 may reduce the audio volume of audio amplifier 206 by communicating an appropriate audio_volume_control signal 217 to audio amplifier 206. After completion of step 408, method 400 may proceed again to step 404.

At step 410, in response to a determination that delivery of power by boost converter 202 has reached its limit, that an over-temperature condition has occurred, or that the vds_sense signal is below a threshold level, and that flash LED driver 204 current reduction is allowed, controller 208 may reduce the current of flash LED driver 204 by communicating an appropriate LED_current_control signal 216 to flash LED driver 204. After completion of step 410, method 400 may proceed again to step 404.

Although FIG. 4 discloses a particular number of steps to be taken with respect to method 400, method 400 may be executed with greater or lesser steps than those depicted in FIG. 4. In addition, although FIG. 4 discloses a certain order of steps to be taken with respect to method 400, the steps comprising method 400 may be completed in any suitable order. For example, if the appropriate conditions exist, both steps 408 and 410 may be executed substantially contemporaneously.

Method 400 may be implemented using IC 200, components thereof, and/or any other system operable to implement method 400. In certain embodiments, method 400 may be implemented partially or fully in software and/or firmware embodied in computer-readable media.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A single integrated circuit, comprising:

a single boost converter that supplies power;

a first circuit that provides a circuit operation coupled to the single boost converter that supplies power to the first circuit;

a second circuit that provides another circuit operation coupled to the single boost converter that supplies power to the second circuit; and a controller coupled to the single boost converter, the first circuit, and the second circuit, wherein the controller receives an operating condition signal indicative of at least one of: (i) a power delivered by the single boost converter; and (ii) a temperature of the single integrated circuit, and in response to the operating condition signal, allocates power deliverable by the single boost converter between the first circuit and the second circuit.

2. The single integrated circuit of claim 1, wherein the controller is a single controller.

3. The single integrated circuit of claim 1, wherein the first circuit is an LED flash driver and the second circuit is an audio amplifier.

4. The single integrated circuit of claim 3, wherein the audio amplifier is a Class-D audio amplifier.

5. The single integrated circuit of claim 1, wherein the operating condition signal is indicative of the power delivered by the single boost converter and is based at least on a power consumption of the first circuit and the second circuit.

6. The single integrated circuit of claim 5, wherein the operating condition signal is indicative of an aggregate power consumption of the first circuit and the second circuit.

7. The single integrated circuit of claim 1, wherein the controller reduces individual power consumption of at least one of the first circuit and the second circuit responsive to a determination that the power delivered by the single boost converter exceeds a threshold power level.

8. The single integrated circuit of claim 7, wherein the threshold power level is a power limit of the single boost converter.

9. The single integrated circuit of claim 7, wherein the controller further receives an operation mode signal and reduces the individual power consumption of at least one of the first circuit and the second circuit responsive to the operation mode signal and responsive to a determination that the power delivered by the single boost converter exceeds the threshold power level.

10. The single integrated circuit of claim 7, wherein the controller further receives an operation mode signal and allocates power deliverable by the single boost converter between the first circuit and the second circuit responsive to the operation mode signal and responsive to a determination that the power delivered by the single boost converter is less than the threshold power level.

11. The single integrated circuit of claim 10, wherein the operation mode signal comprises at least one of: a current setting for the first circuit, an audio volume setting for the second circuit, a current reduction setting regarding whether the controller is permitted to reduce a current for the first circuit below the current setting, and an audio volume reduction setting regarding whether the controller is permitted to reduce an audio volume for the second circuit below the audio volume setting.

12. The single integrated circuit of claim 1, wherein the operating condition signal is indicative of the temperature of the single integrated circuit, and the controller reduces individual power consumption of at least one of the first circuit and the second circuit responsive to a determination that the temperature exceeds a threshold temperature level.

13. The single integrated circuit of claim 12, wherein the threshold temperature level is a temperature limit of the single integrated circuit.

14. The single integrated circuit of claim 12, wherein the controller further receives an operation mode signal and allocates power deliverable by the single boost converter between the first circuit and the second circuit responsive to the operation mode signal and responsive to a determination that the temperature is less than the threshold temperature level.

15. The single integrated circuit of claim 1, wherein the operating condition signal is indicative of the power delivered by the single boost converter and comprises a power limit indicator of the single boost indicator indicating that the power delivered by the single boost converter exceeds a power limit of the single boost converter.

16. A method comprising:

supplying, by a single boost converter, power to the first circuit that provides a circuit operation;

supplying, by the single boost converter, power to the second circuit that provides another circuit operation;

receiving, by a controller coupled to the single boost controller, an operating condition signal indicative of at least one of: (i) a power delivered by the single boost converter; and (ii) a temperature of the single integrated circuit; and allocating, by the controller, power deliverable by the single boost converter between the first circuit and second circuit in response to the operating condition signal.

17. The method of claim 16, wherein the controller is a single controller.

18. The method of claim 16, wherein the first circuit is an LED flash driver and the second circuit is an audio amplifier.

19. The method of claim 18, wherein the audio amplifier is a Class-D audio amplifier.

20. The method of claim 16, wherein the operating condition signal is indicative of the power delivered by the single boost converter and is based at least on a power consumption of the first circuit and the second circuit.

21. The method of claim 20, wherein the operating condition signal is indicative of an aggregate power consumption of the first circuit and the second circuit.

22. The method of claim 16, further comprising reducing, by the controller, individual power consumption of at least one of the first circuit and the second circuit responsive to a determination that the power delivered by the single boost converter exceeds a threshold power level.

23. The method of claim 22, wherein the threshold power level is a power limit of the single boost converter.

24. The method of claim 22, further comprising:

receiving, by the controller, an operation mode signal; and reducing, by the controller, individual power consumption of at least one of the first circuit and the second circuit responsive to the operation mode signal and responsive to a determination that the power delivered by the single boost converter exceeds the threshold power level.

25. The method of claim 22, further comprising:

receiving, by the controller, an operation mode signal; and allocating, by the controller, power deliverable by the single boost converter between the first circuit and the second circuit responsive to the operation mode signal and responsive to a determination that the power delivered by the single boost converter is less than the threshold power level.

26. The method of claim 25, wherein the operation mode signal comprises at least one of: a current setting for the first circuit, an audio volume setting for the second circuit, a current reduction setting regarding whether the controller is permitted to reduce a current for the first circuit below the current setting, and an audio volume reduction setting regarding whether the controller is permitted to reduce an audio volume for the second circuit below the audio volume setting.

27. The method of claim 16, wherein the operating condition signal is indicative of the temperature of the single integrated circuit, the method further comprising reducing, by the controller, individual power consumption of at least one of the first circuit and the second circuit responsive to a determination that the temperature exceeds a threshold temperature level.

28. The method of claim 27, wherein the threshold temperature level is a temperature limit of the single integrated circuit.

29. The method of claim 27, further comprising:

receiving, by the controller, an operation mode signal; and allocating, by the controller, power deliverable by the single boost converter between the first circuit and the second circuit responsive to the operation mode signal and responsive to a determination that the temperature is less than the threshold temperature level.

30. The method of claim 16, wherein the operating condition signal is indicative of the power delivered by the single boost converter and comprises a power limit indicator of the single boost indicator indicating that the power delivered by the single boost converter exceeds a power limit of the single boost converter.

* * * * *